US006557192B2

(12) United States Patent
Zheng

(10) Patent No.: US 6,557,192 B2
(45) Date of Patent: May 6, 2003

(54) SLEEPING BAG WITH ENHANCEMENTS

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 125 days.

(21) Appl. No.: 09/752,633

(22) Filed: Jan. 2, 2001

(65) Prior Publication Data

US 2002/0083525 A1 Jul. 4, 2002

(51) Int. Cl.[7] ..... A47C 29/00
(52) U.S. Cl. ..... 5/413 R; 5/482
(58) Field of Search ..... 5/413 R, 413 AM, 5/482; 2/69.5

(56) References Cited

U.S. PATENT DOCUMENTS

| | | | | |
|---|---|---|---|---|
| 2,870,464 A | | 1/1959 | Lalick | |
| 3,801,420 A | | 4/1974 | Anderson | |
| 4,757,832 A | | 7/1988 | Russell | |
| 4,841,587 A | * | 6/1989 | Carter et al. | 455/344 |
| 4,856,131 A | | 8/1989 | Mills | |
| 4,888,837 A | | 12/1989 | Wang | |
| 4,890,347 A | | 1/1990 | Fuller | |
| 4,972,533 A | | 11/1990 | Brown | |
| 5,024,262 A | | 6/1991 | Huang | |
| 5,056,172 A | | 10/1991 | Kaiser et al. | |
| D323,921 S | | 2/1992 | Kawchak | |
| 5,084,930 A | * | 2/1992 | Danova | 446/73 |
| 5,116,273 A | | 5/1992 | Chan | |
| 5,421,045 A | | 6/1995 | Bowen | |
| 5,548,858 A | | 8/1996 | Shoa | |
| D378,969 S | | 4/1997 | Roan | |
| 5,693,398 A | | 12/1997 | Granger | |
| D393,877 S | | 4/1998 | Allegre | |
| D408,192 S | | 4/1999 | Chiang | |
| 6,073,283 A | | 6/2000 | Zheng | |
| 6,128,796 A | | 10/2000 | Pariseau | |
| 6,313,438 B1 | * | 11/2001 | Emerick, Jr. | 2/69 |

FOREIGN PATENT DOCUMENTS

| | | |
|---|---|---|
| FR | 2400873 | 3/1979 |

* cited by examiner

*Primary Examiner*—Heather Shackelford
*Assistant Examiner*—Lisa M. Saldano
(74) *Attorney, Agent, or Firm*—Raymond Sun

(57) ABSTRACT

A sleeping apparatus has an outer layer having an inner liner superimposed and coextensive with the outer layer and connected to each other, and an amusement feature provided on either the outer surface of the inner liner or the outer surface of the outer layer. A rigid pad can be positioned between the inner liner and the outer layer, or coupled to the outer surface of either the inner liner or the outer layer. As an alternative, the sleeping apparatus can have a panel having a foldable frame member having a folded and an unfolded orientation, with a fabric material covering portions of the frame member to form the panel when the frame member is in the unfolded orientation. This sleeping apparatus also includes a blanket portion coupled to the panel in a manner to define an internal sleeping space.

18 Claims, 16 Drawing Sheets

SLEEPING BAG WITH ENHANCEMENTS

BACKGROUND OF THE INVENTION

1. Field of the Invention

The present invention relates to sleeping or slumber bags, or related sleeping mats.

2. Description of the Prior Art

A conventional sleeping bag usually has an outer case and a co-extensive inner liner. The case and liner are secured together along their edges with the space between those layers filled with insulation or padding of one kind or another to form a pad. Usually, mating zipper slides are secured to the side and bottom edges of the pad so that when the pad is folded in half from side to side, a zipper slider may be pulled along the slides to form the sleeping bag which may be entered through the opening at the head of the bag.

Sleeping bags have become increasingly popular with children for home use, travel, and for overnight visits with friends and family. Manufacturers of children's sleeping bags have made use of familiar indicia, graphics, and designs, as well as toy and cartoon characters, which are printed on the outer case and inner liners of the sleeping bags to attract attention and to make the sleeping bag more endearing to children.

Despite the attempts to provide visual enhancements to conventional sleeping bags, there is still a need to provide additional fun and activity to sleeping bags.

SUMMARY OF THE DISCLOSURE

The present invention provides a sleeping apparatus that has an outer layer having an inner liner superimposed and coextensive with the outer layer and connected to each other, and an amusement feature provided on either the outer surface of the inner liner or the outer surface of the outer layer. A rigid pad can be positioned between the inner liner and the outer layer, or coupled to the outer surface of either the inner liner or the outer layer.

The present invention also provides, in another embodiment, a sleeping apparatus having a panel having a foldable frame member having a folded and an unfolded orientation, with a fabric material covering portions of the frame member to form the panel when the frame member is in the unfolded orientation. This sleeping apparatus also includes a blanket portion coupled to the panel in a manner to define an internal sleeping space.

DETAILED DESCRIPTION OF THE PREFERRED EMBODIMENTS

Figures 1, 2:
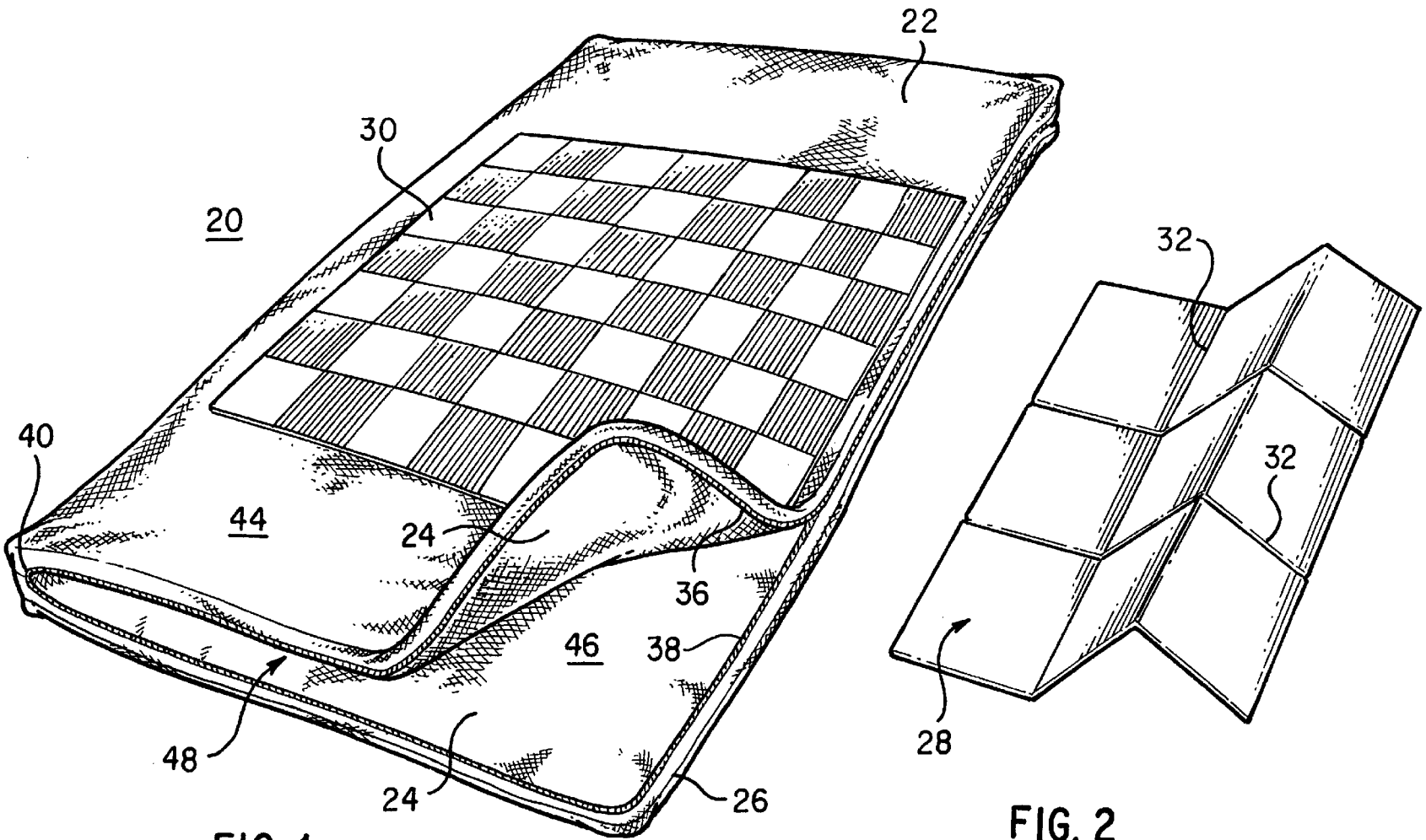
FIG. 1 is a perspective view of a sleeping bag according to one embodiment of the present invention.
FIG. 2 is a perspective view of the inner pad that is used with the sleeping bag of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1–3 and 13, a sleeping bag 20 according to one embodiment of the present invention has a generally rectangular outer layer 22 (also referred to as "case") that is made of a suitable water-resistant sheet material, and a co-extensive inner rectangular layer or liner 24 that is preferably of a nappy material such as flannel. The layers 22 and 24 are connected together around their perimeters by stitching 26 to form a two-layer panel. The air space between the layers 22 and 24 provides a certain amount of insulation. If additional insulation is required, conventional insulating material or padding (not shown) may be inserted between the layers 22 and 24 and held in place by additional stitching extending across the layers 22 and 24 at spaced apart locations thereon.

A relatively rigid pad 28 can be positioned between the layers 22 and 24 to form a solid or rigid backing for a game board or other feature 30 that is to be provided on the outer surface of either or both of the case 22 and the liner 24. The pad 28 can be positioned between the layers 22 and 24 before they are stitched together. It is also possible to stitch the pad 28 to certain predetermined locations on the two layers 42, 44. As shown in FIG. 2, the pad 28 can be provided in a corrugated form or with pre-folds 32 to allow the pad 28 to be folded when the sleeping bag 20 is folded for storage. The pad 28 can be made from a lightweight material that is capable of providing sufficiently rigidity to function as a game board or to support an activity thereon, and can include materials such as, but not limited, to cardboard, plastic, a thin metal sheet (such as aluminum), wood, fiberglass, resin and foam, among others. The pad 28 can be provided in any desired size, including a size up to the size of the two layers 22, 24. However, the pad 28 should have a size that is at least large enough to provide a backing and support for the intended feature 30.

Figure 3:
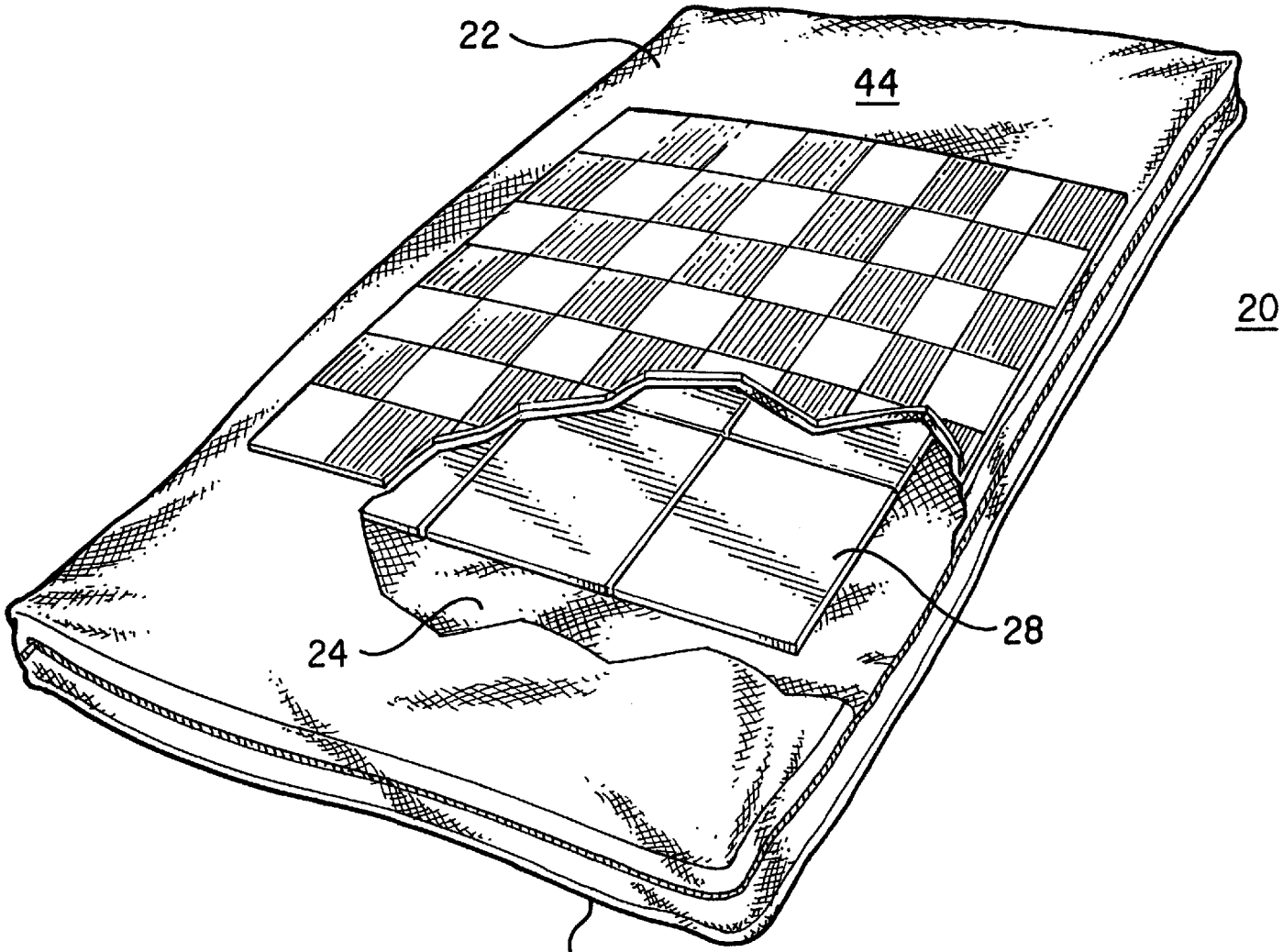
FIG. 3 is perspective cutaway view of the sleeping bag of FIG. 1 illustrating how the inner pad is fitted inside the sleeping bag.

As illustrated in FIGS. 1 and 3, the feature 30 can be a game board that is provided on a portion of the outer surface 44 of the case 22 so that the user can use the sleeping bag 20 as a game board for playing chess or checkers. The game board can be a fabric piece that is stitched on to the outer surface 44 of the case 22, or can be formed by a stitch pattern that makes up the desired game board design. Here, the game board is provided on half of the outer surface 44 of the case 22, which is the upper half of the outer surface of the case 22 after the sleeping bag 20 has been folded over. The game board can also occupy most of the outer surface 44 of the case 22 or most of the entire outer surface 46 of the liner 24 if a larger game board were desired. For example, FIG.

13 illustrates a smaller game board 30*a* positioned at about the center of the outer surface 46 of the liner 24. Thus, the sleeping bag 20 can provide two separate and different game boards 30 and 30*a* on its two opposite surfaces 44 and 46.

Zipper slides 36 and 38 can be secured by stitching 26 to the opposite side edges of the panel, and to the bottom of the panel on opposite sides of a vertical centerline 40, so that when the panel is folded along the centerline 40, the zipper slides 36 and 38 may be joined together by a zipper slider to form the sleeping bag 20 shown in FIG. 1. It is possible to use other fasteners, such as hook and loop fasteners, snap fasteners, and the like, in lieu of the zipper. Access to the interior of the sleeping bag 20 can be through the open head 48 of the bag 20.

Figure 4A:
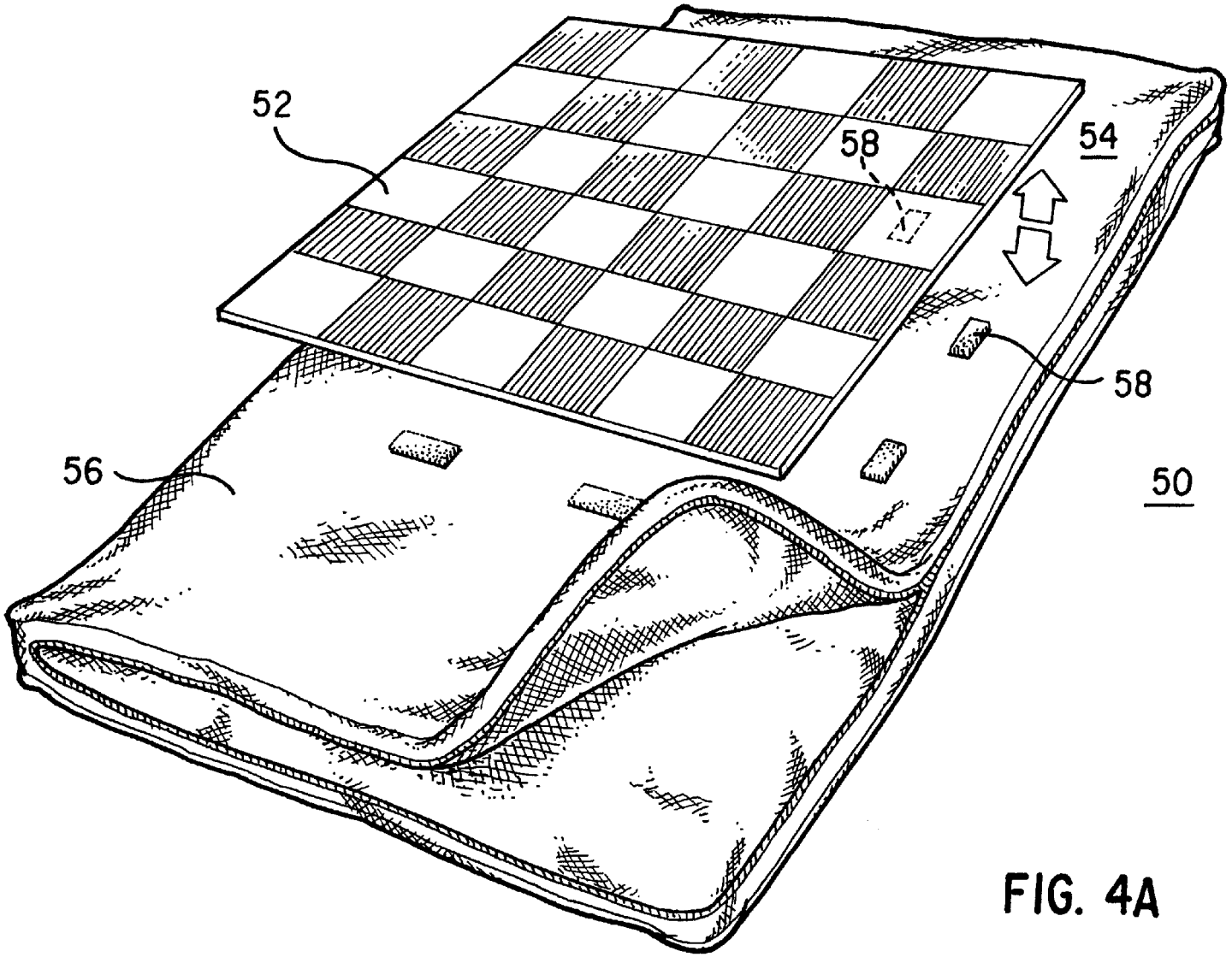
FIGS. 4A–4D, 5, 6 and 7 are perspective views of sleeping bags according to different embodiments of the present invention.

FIG. 4A illustrates another embodiment of a sleeping bag 50 according to the present embodiment. The sleeping bag 50 is the same as sleeping bag 20, except that the pad 28 is omitted from the sleeping bag 50, and in its place, an external pad 52 (which can have the same characteristics as the pad 28) can be removably or permanently attached to the outer surface 54 of the outer layer or case 56. For example, the external pad 52 can be stitched to the outer surface 54, or can be removably coupled by opposing VELCRO™ pads 58. A desired game board design can be provided on the external pad 52.

Figure 4B:
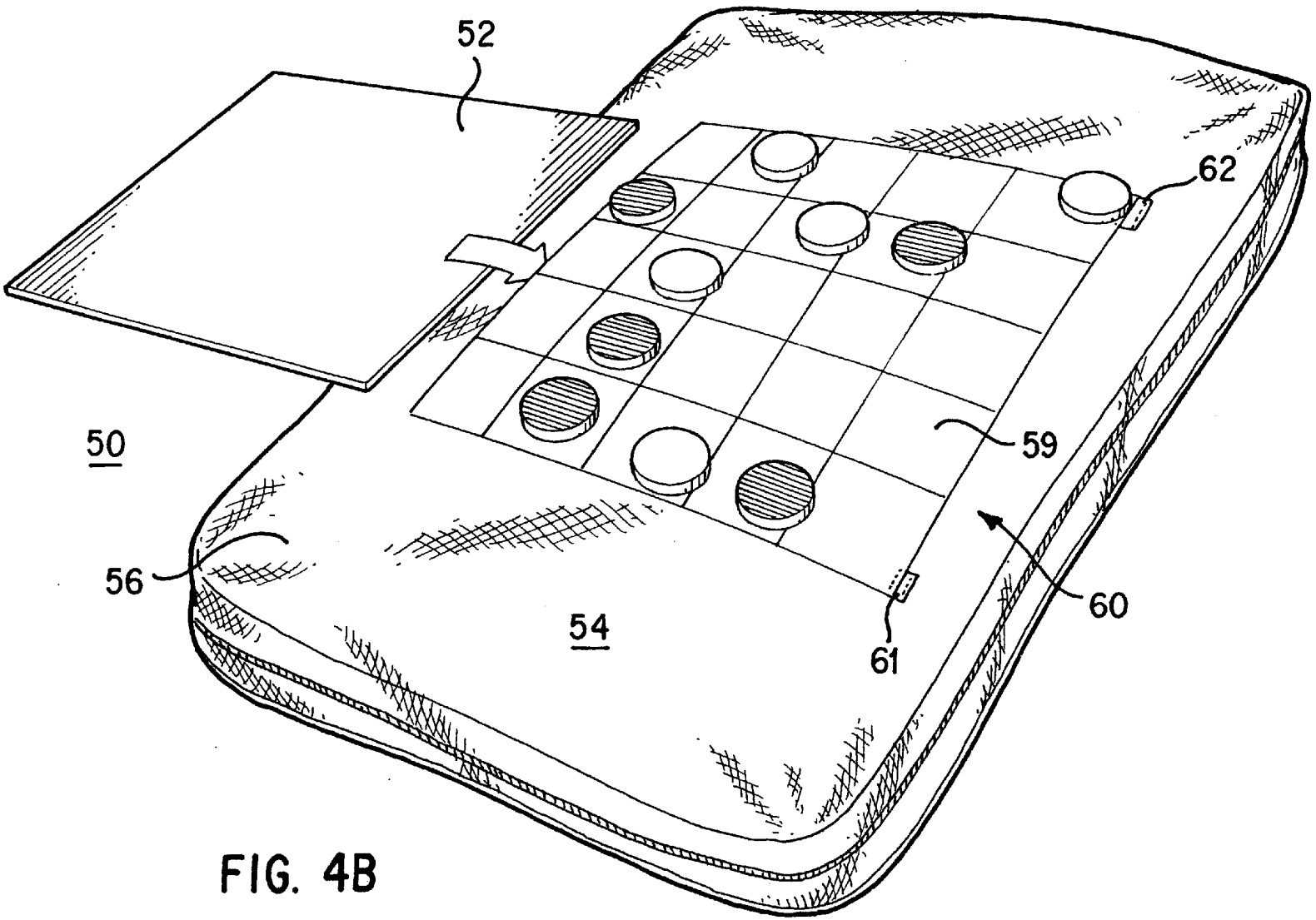

FIG. 4B illustrates a modification that can be made to the sleeping bag 50 in FIG. 4A. In FIG. 4B, a fabric piece 59 having a feature or pattern (e.g., a game board) provided thereon can be stitched to the outer surface 54 of the sleeping bag 50 in a manner to form a sleeve 60. In particular, opposing edges 61 and 62 can be stitched to the outer surface 54, and an external pad 52 (which can be the same as the pad 52 in FIG. 4A) can be slid into the sleeve 60 to function as a support for the game board. The pad 52 can be removed when the sleeping bag 50 is to be folded up for storage.

Figure 4C:
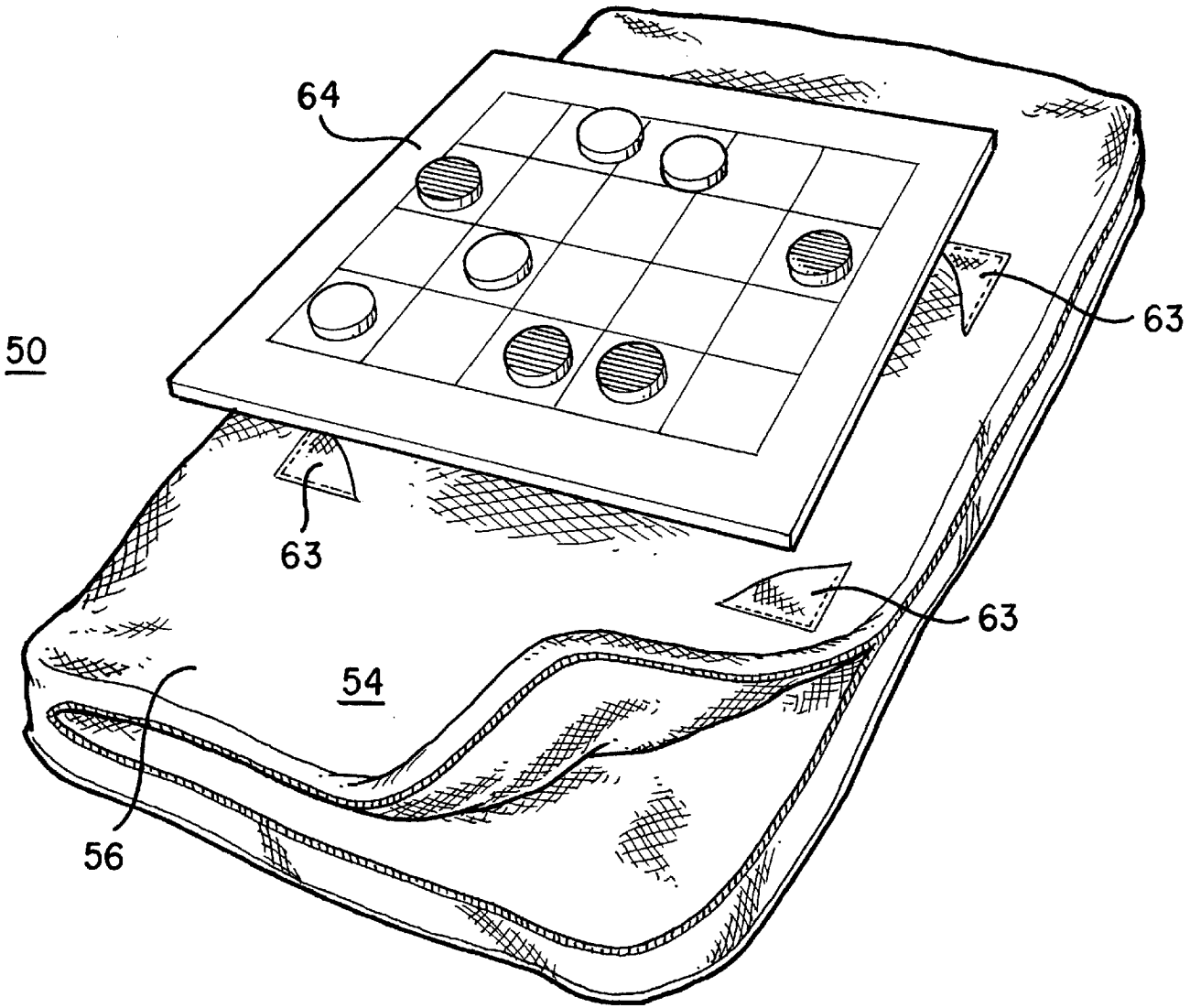

FIG. 4C illustrates another modification that can be made to the sleeping bag 50 in FIG. 4A. In FIG. 4C, instead of the VELCRO™ pads 58, four corner pieces 63 can be positioned on the outer surface 54 of the sleeping bag 50. An external pad 64 (which can be the same as the pad 52 in FIG. 4A) having a pattern or feature (e.g., a game board) provided on a top surface 65 can be fitted into the space defined by the corner pieces 63, and retained by the corner pieces 63. The pad 64 can be removed when the sleeping bag 50 is to be folded up for storage.

Figure 4D:
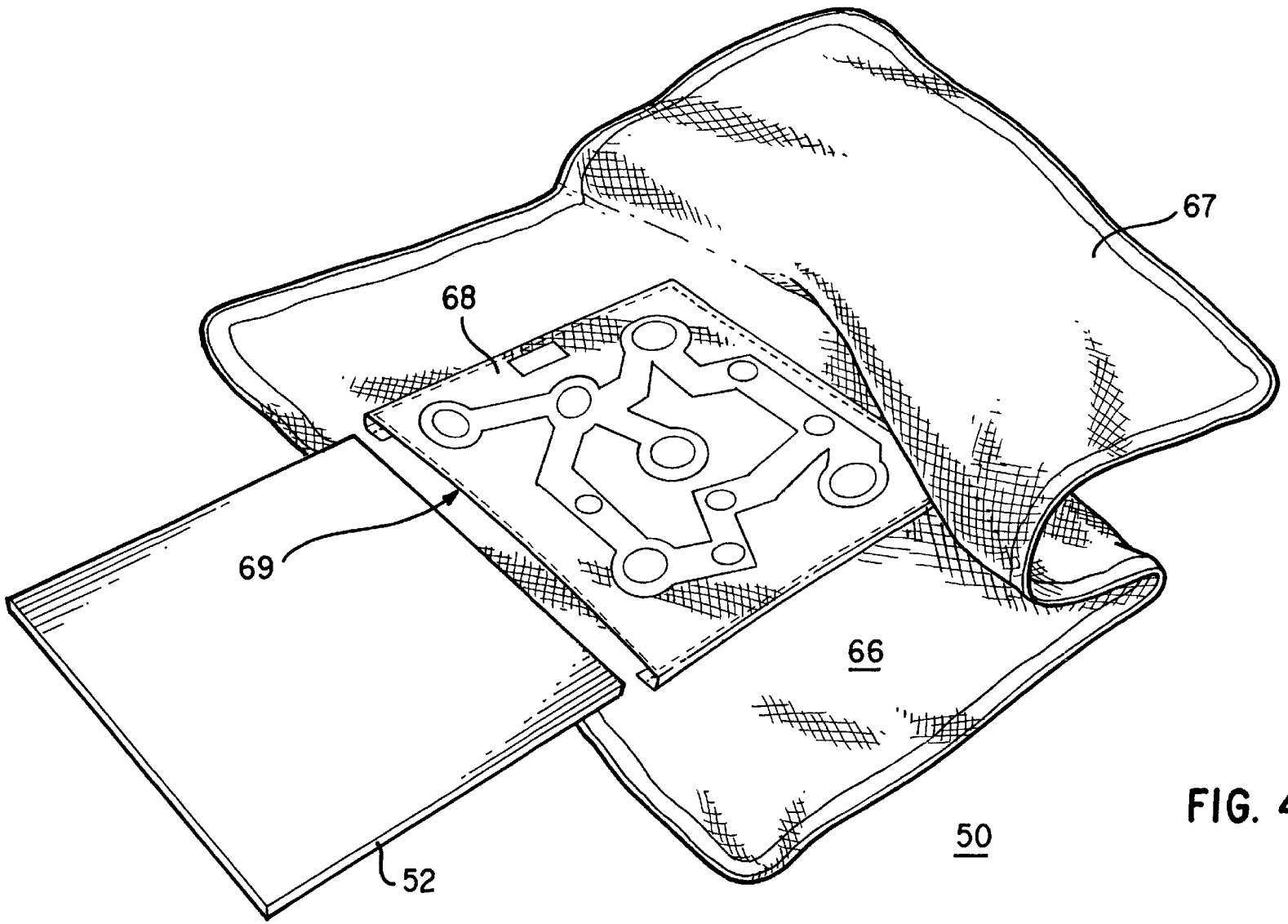
Figure 7:
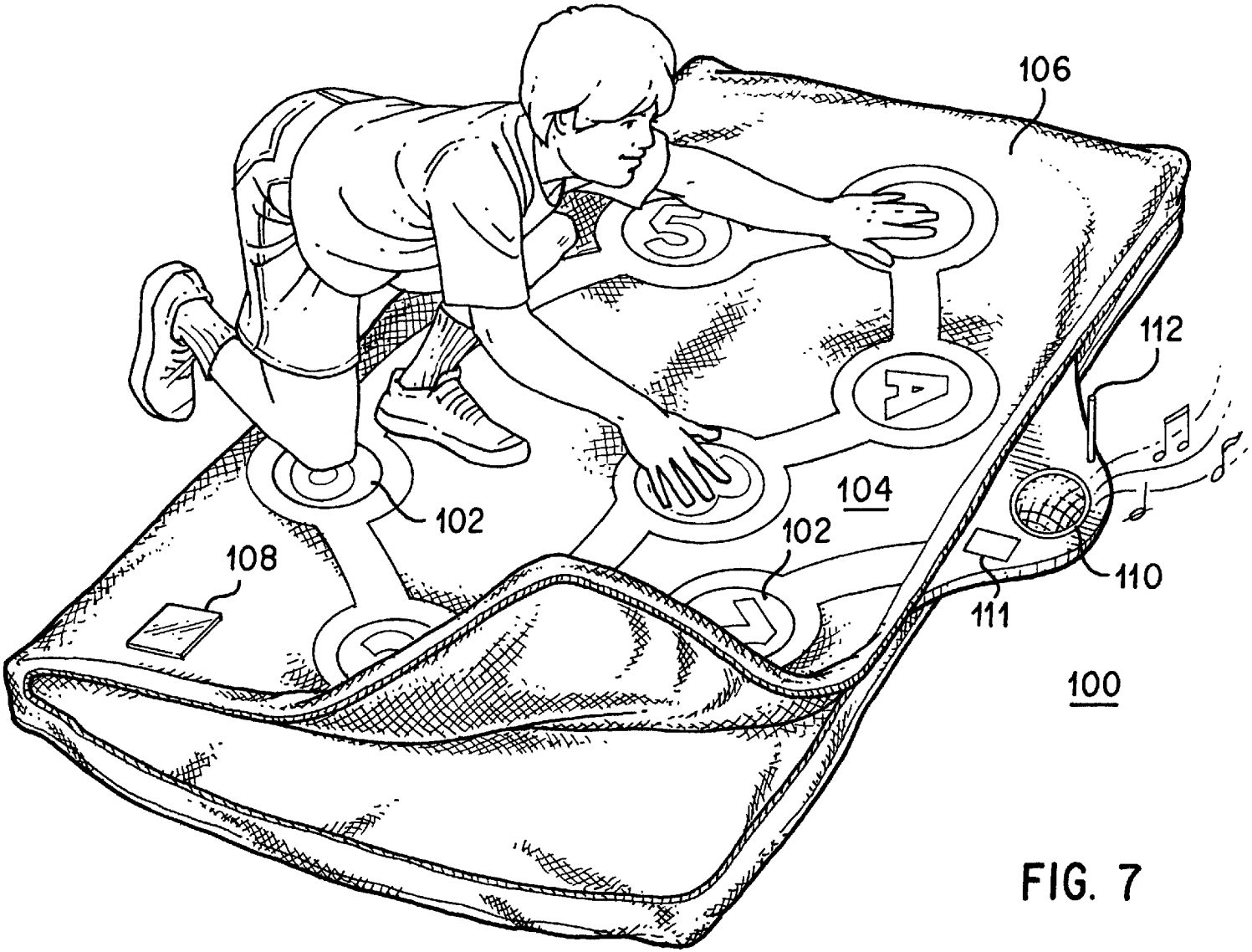
Figure 8:
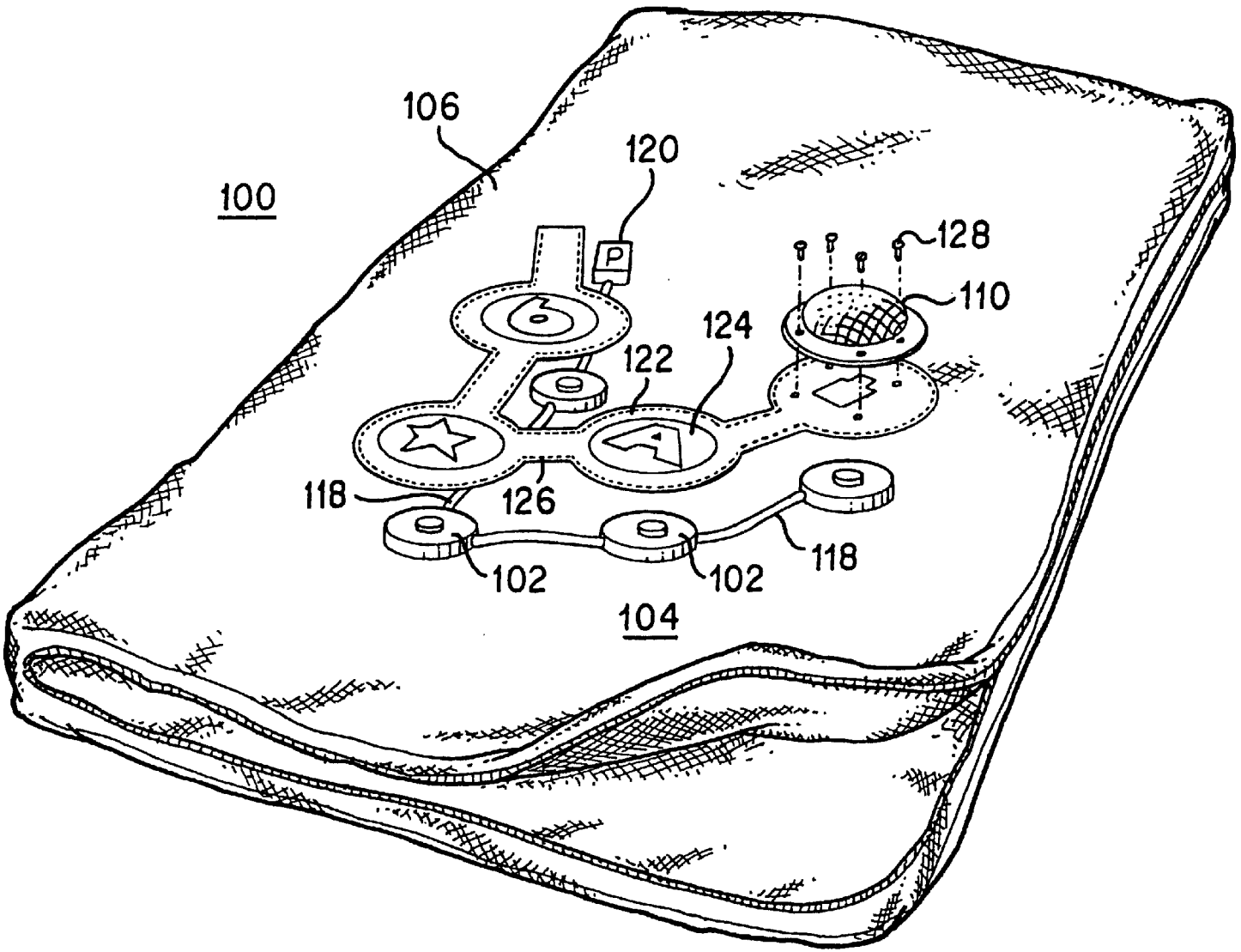
FIGS. 8–9 illustrate different ways of electrically coupling the features of the sleeping bag of FIG. 8.
Figure 9:
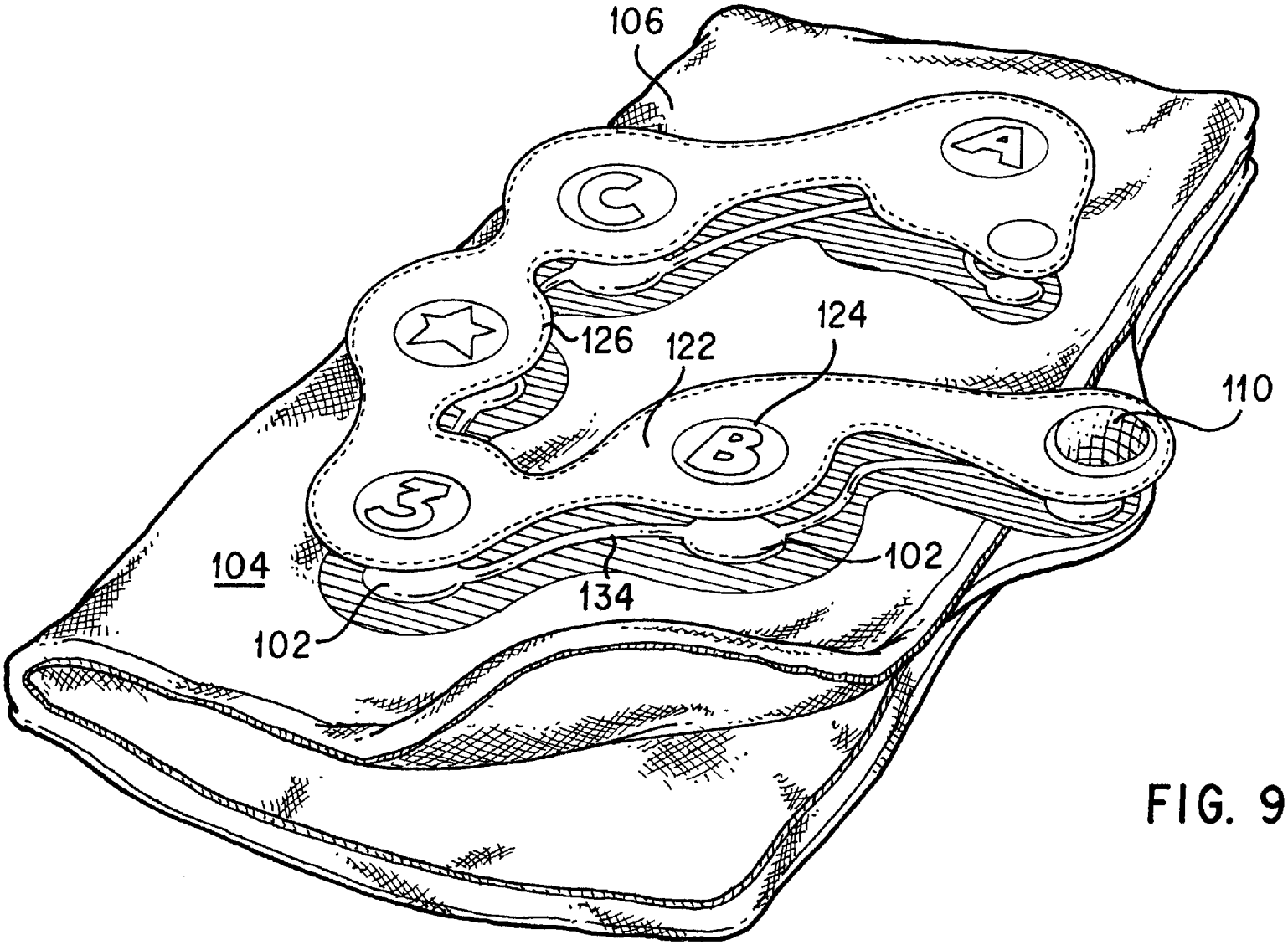

FIG. 4D illustrates a modification that can be made to the sleeping bags 50 in FIGS. 4A and 4B. In FIG. 4C, the outer surface 66 of the liner 67 is provided with a fabric piece 68 forming a sleeve 69. A pattern or feature (e.g., a game board, an electronic game as illustrated in FIGS. 7–9 below, etc.) can be provided on the top surface of the fabric piece 68. The external pad 52 in FIGS. 4A and 4B can be slid into the sleeve 69 to function as a support for the pattern or feature. The pad 52 can be removed when the sleeping bag 50 is to be folded up for storage.

Figure 5:
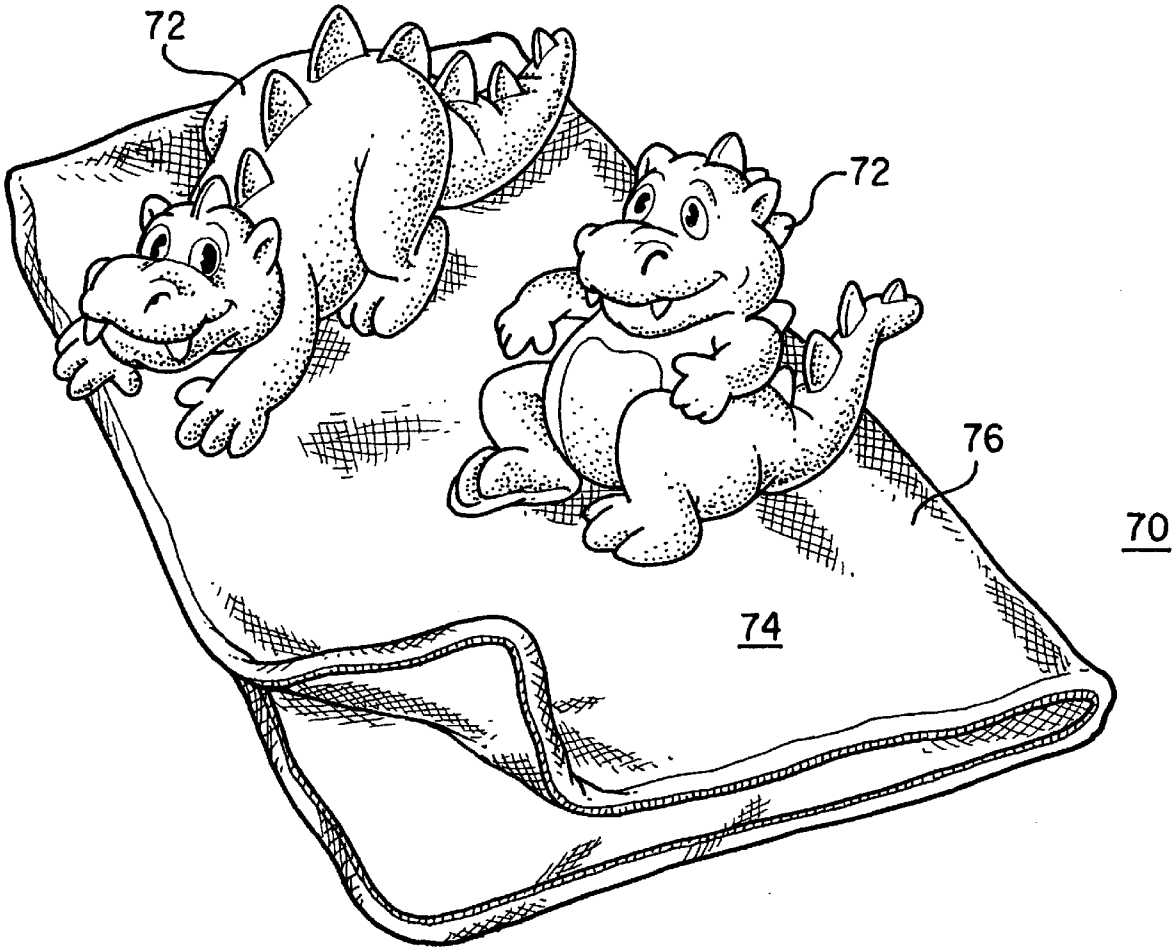

Although FIGS. 1–4C illustrate the feature 30 as being a game board, it is possible for the feature to include any design, item, element or feature that promotes an activity. For example, FIG. 5 illustrates a sleeping bag 70 that is the same as sleeping bag 20, except that a plurality of three-dimensional objects (such as stuffed toys 72) can be removably (e.g., using VELCRO™ pads) or permanently attached (e.g., by stitching) to the outer surface 74 of the outer layer or case 76.

Figure 6:
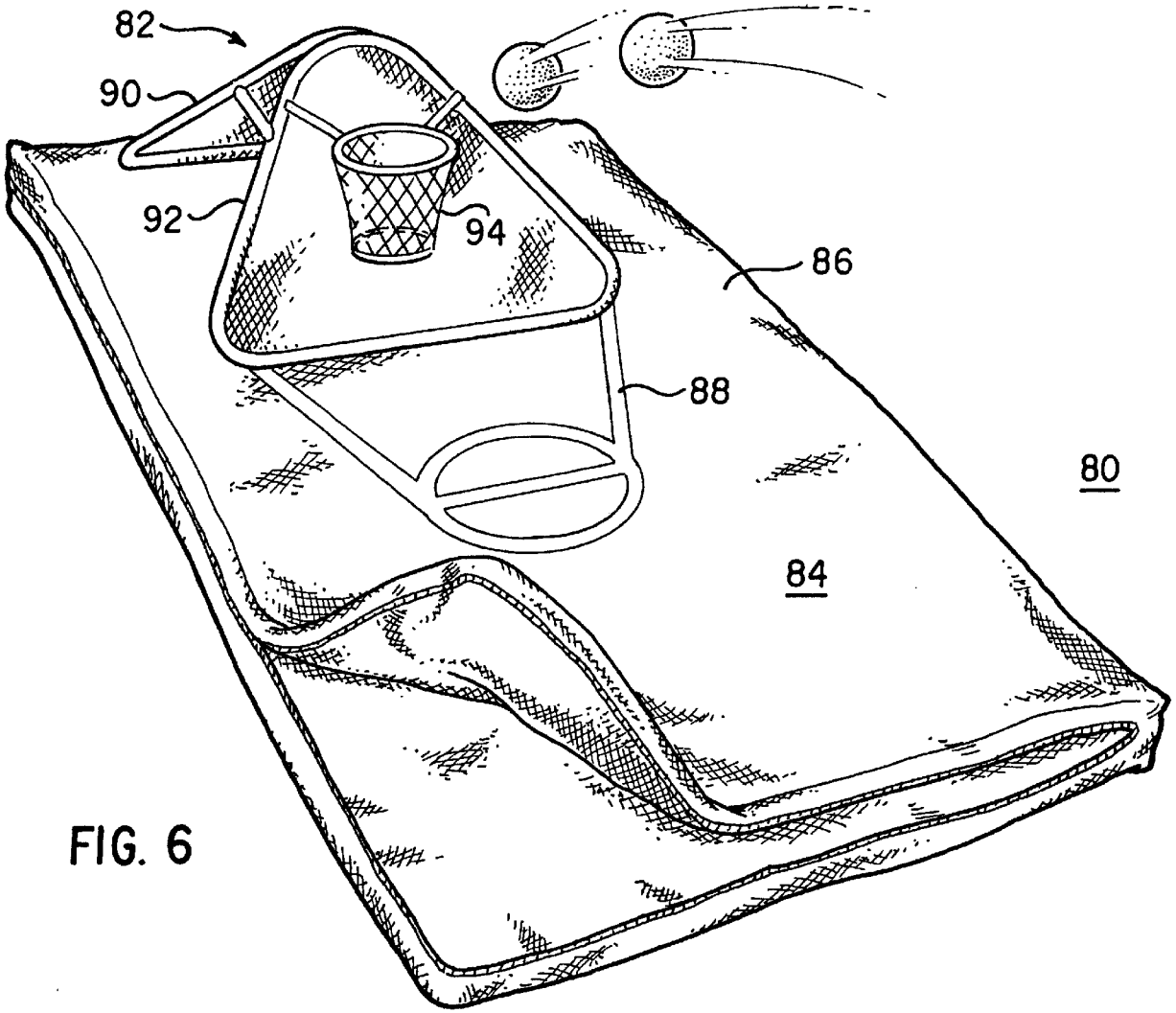

As a further example, FIG. 6 illustrates a sleeping bag 80 that is the same as sleeping bag 20, except that a portable basket assembly 82 can be removably (e.g., using VELCRO™ pads) or permanently attached to the outer surface 84 of the outer layer or case 86, and indicia 88 that represents a basketball court can be stitched or otherwise provided on the outer surface 84 to complement the basket assembly 82. The basket assembly 82 can comprise two panels 90 and 92 that are provided in an inverted V-shaped configuration, with a panel 92 supporting a basket or hoop 94. The basket assembly 82 can be embodied in any known form, and some examples are illustrated in FIG. 8 of U.S. Pat. No. 6,155,281 and FIGS. 2, 4, 6 and 8 of U.S. Pat. No. 6,030,300, whose disclosures are incorporated by this reference as though fully set forth herein.

It is also possible for these features 30 to be electrical appliances or components (such as the light bulbs, antennas, screens, touch sensors, on-off pads, and speakers, among others) that may need to be coupled to a power source to be driven, and may need to be coupled to processors for receiving and/or transmitting control, data or other signals. These electrical components and features can be attached to the outer surface 44 of the case 22 by either stitching, glue or any other known connection mechanisms. If necessary, wires can be coupled to these electrical components and power sources and processors for ensuring the transmission of power and signals therebetween, as illustrated below in connection with FIGS. 7–9. These electrical components can even communicate with a computer that can be provided either on the case 22 or liner 24 of the sleeping bag 20, or at a remote location and in wireless (e.g., RF) communication with an antenna that is coupled to the sleeping bag 20.

FIG. 7 illustrates another sleeping bag 100 that can be the same as sleeping bag 20, except that the game board feature 30 is now replaced by a plurality of touch pads 102 that are secured to the outer surface 104 of the outer layer or case 106. Each touch pad 102 can carry a different indicia (e.g., character, letter, number, etc.), and all the touch pads 102 can together form a path for a game or activity. The variety and amusement value of these games and activities, including any computer-programmed games, will depend on the features 30 provided with the sleeping bag 20. A screen (e.g., 108 in FIG. 7) can even be used to display the results of these games, which can be measured by, for example, sensors on the touch pads 102.

As yet another example, these features 30 can provide the basis for educational games. For example, a speaker 110 can broadcast tasks that require a child to do a broadcasted task several times, and having the child count the number of times that the task has been performed. As another example, numbered graphics can be provided on these touch pads 102 and coupled (via the conductive paths and wiring described in connection with FIGS. 8 and 9 below) to a processor 111, which can control a game in which the different numbered graphics are made to light up at different times, in which a child is to follow the lighted graphics in (a) moving about the path on the outer surface 104, (b) recognizing and repeating the lighted numbers, and (c) adding the lighted number to the previous sum, among others. The speaker can make announcements, emit congratulatory praises, or emit any other desired sounds or music. Other variations and themes for games utilizing numbered graphics are also possible, and can vary based on the educational or other objective(s) that are intended to be accomplished.

Figure 14:
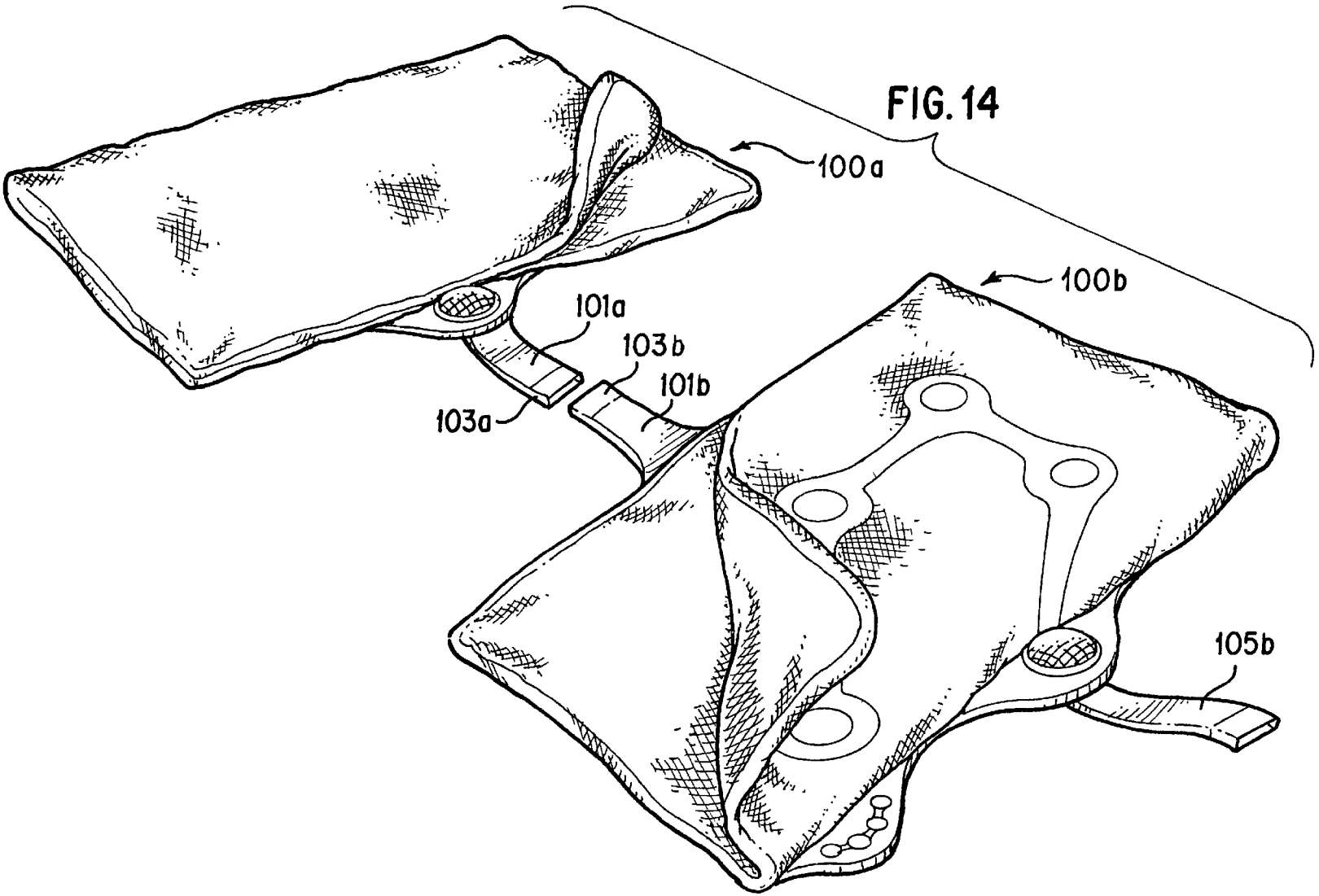
FIG. 14 illustrates how two of the sleeping bags from FIG. 7 can be electronically coupled.

As a further non-limiting example, the touch pads 102, antenna 112, processor 111, screen 108 and speaker 110 can even be the components that make up an interactive computer system that is capable of communicating (via wireless transmission, or a linked communication as illustrated in FIG. 14 below) with other computing systems. Thus, the sleeping bag 100 can actually form an "interactive" or "computing" station for a user, where the user can use the touch pads 102 as input devices, and the screen 108 as an output device, for playing games, doing word processing, surfing the Internet, and communicating with other computing systems. Other features 30 that can be incorporated with the sleeping bag 20 include cellular phones, microphones, musical instruments, radios, zippers, snaps, tethered balls, squeeze items, pinwheels or spinning wheels, sockets, slap items (i.e., items that emit sounds when slapped), buckles, corks, whistles, pedals, and doorbells, among others. Thus, the structures 20 and 100 in FIGS. 1 and 7 provide the user with much added utility, educational value, and play variety.

FIG. 8 illustrates one method for electrically coupling the touch pads 102 and speaker 110. The other electrical elements (e.g., the antenna 112, screen 108, processor 111) can all be coupled using the same principles. A plurality of touch pads 102 are attached (e.g., by glue or stitching) to selected locations on the outer surface 104 of the case 106, and connected by wires 118 to a power source 120 which can be a battery pack. A fabric or other cover 122 can be provided which is configured or cut to follow the path created by the touch pads 102 and the wires 118. Specific indicia 124 can be stitched or otherwise attached to the locations on the cover 122 that would overlie the corresponding touch pads 102. The cover 122 is then stitched (along stitch lines 126) to the outer surface 104 of the case 106 to cover and protect the touch pads 102 and wires 118. Instead of using stitching, the speaker 110 can be attached to the cover 122 by screws 128.

FIG. 9 illustrates another method for electrically coupling the touch pads 102 and other electrical elements (e.g., speaker 110). As with FIG. 8, a plurality of touch pads 102 are attached (e.g., by glue or stitching) to selected locations on the outer surface 104 of the case 106, but the electrical connections are accomplished by conductive paths 134. A fabric or other cover 122 can still be provided which is configured or cut to follow the path created by the touch pads 102 and the conductive paths 134. Specific indicia 124 can be stitched or otherwise attached to the locations on the cover 122 that would overlie the corresponding touch pads 102. The cover 122 is then stitched (along stitch lines 126) to the outer surface 104 of the case 106 to cover and protect the touch pads 102 and conductive paths 134. Each conductive path 134 can include the conductive lines, stripes, traces, compositions, inks, liquids, pastes, granules and colored inks, and can utilize the electrical systems and attachment techniques, described in U.S. Pat. No. 5,455,749 to Ferber, U.S. Pat. No. 5,371,657 to Wiscombe, U.S. Pat. No. 5,626,948 to Ferber et al., and U.S. Pat. No. 5,973,420 to Kaiserman et al., as well as those that are known in the art. One non-limiting example of a material that can be used as a conductive ink is a material sold under the tradename 102–05F by Creative Materials of Tyngsboro, Mass. Other materials are described in one or more of U.S. Pat. No. 5,455,749 to Ferber, U.S. Pat. No. 5,371,657 to Wiscombe, U.S. Pat. No. 5,626,948 to Ferber et al., and U.S. Pat. No. 5,973,420 to Kaiserman et al.

Figure 10:
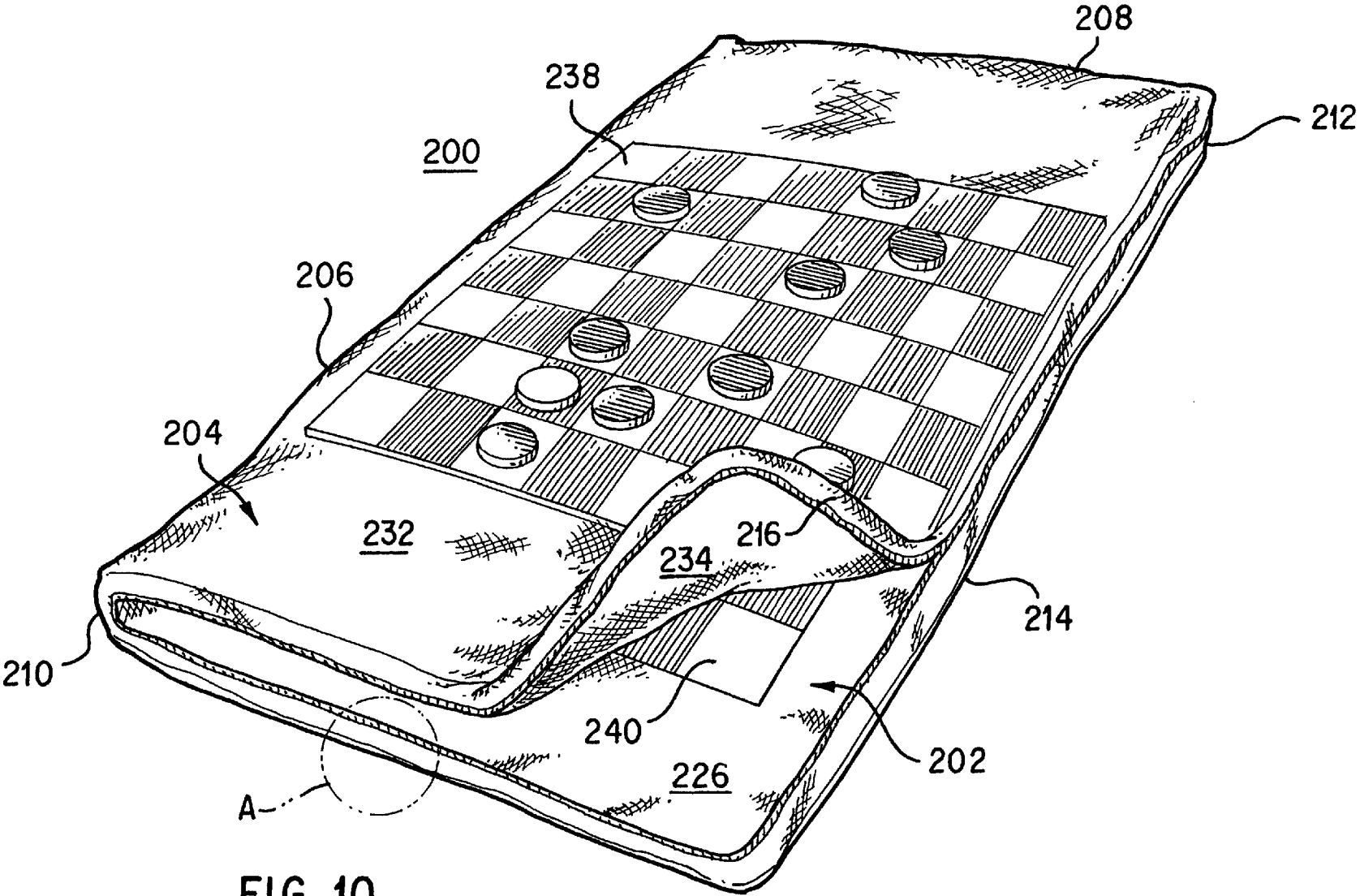
FIG. 10 is a perspective view of a sleeping bag according to yet another embodiment of the present invention.
Figure 11:
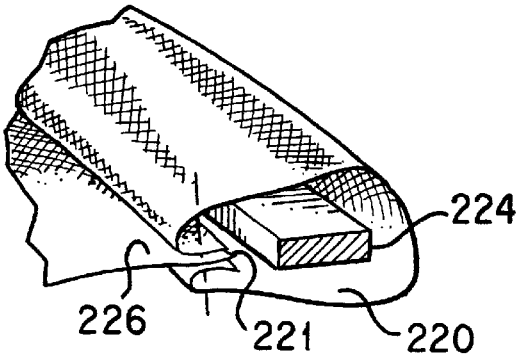
FIG. 11 is a partial cut-away view of the section A of the structure of FIG. 10 illustrating a frame member retained within a sleeve.

FIGS. 10 and 11 illustrate a sleeping bag 200 according to yet a different embodiment of the present invention. The sleeping bag 200 has a base panel 202 that is separate from a blanket portion 204. The blanket portion 204 can be made in the same manner as the sleeping bag 20 (and its case 22 and liner 24) described above in connection with FIGS. 1–3 and 13, with or without the pad 28. The blanket 204 can be stitched or removably attached (e.g., via VELCRO™ pads, hooks, zippers, etc.) along one of its vertical sides 206 and its bottom side 208 to a vertical side 210 and bottom side 212 of the panel 202 to define an internal sleeping space. The other vertical sides 214 and 216 of the panel 202 and the blanket portion 204, respectively, can be zippered in the same manner described about for sleeping bag 20.

The panel 202 has a continuous frame retaining sleeve 220 that is provided along and traverses the four edges of the four sides 210, 212, 214 and 222. The sleeve 220 is formed by folding a piece of fabric and applying a stitching 221. Even though the panel 202 is illustrated as having four sides, it can have any number of sides, or each side can even be curved. A continuous frame member 224 is retained or held within the frame retaining sleeve 220 to support the panel 202. The continuous frame member 224 can be provided as one continuous loop, or may comprise a strip of material connected at both ends to form a continuous loop. The continuous frame member 224 can be formed of flexible coilable steel having a memory, although other materials such as plastics, or a combination of plastics and metal, may also be used. The frame member 224 should be made of a material which is relatively strong and yet is flexible to a sufficient degree to allow it to be coiled. Thus, the frame member 224 is capable of assuming two positions or orientations, an open or expanded position such as shown in FIG. 10, or a folded position in which the frame member is collapsed into a size which is much smaller than its open position (see FIG. 12D). It is also possible for the principles of the present invention to be utilized with frame members that do not have a memory characteristic (i.e., not foldable or coilable).

Fabric or sheet material 226 extends across portions of the panel 202, and is held taut by the frame member 224 when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame member 224 may be merely retained within the frame retaining sleeve 220 without being connected thereto. Alternatively, the frame retaining sleeve 220 may be mechanically fastened, stitched, fused, or glued to the frame member 224 to retain it in position.

Figure 12B:
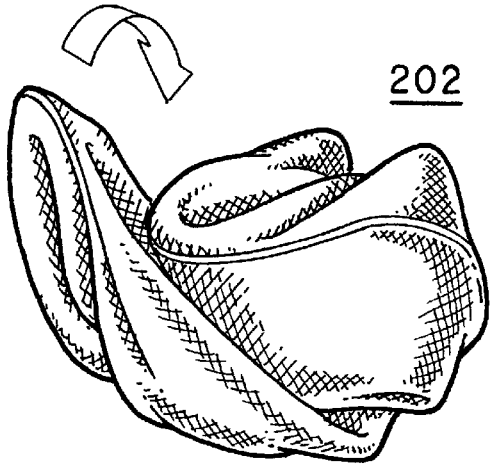
FIGS. 12A through 12D illustrate how the panel of FIG. 10 may be twisted and folded for compact storage.
Figure 12A:
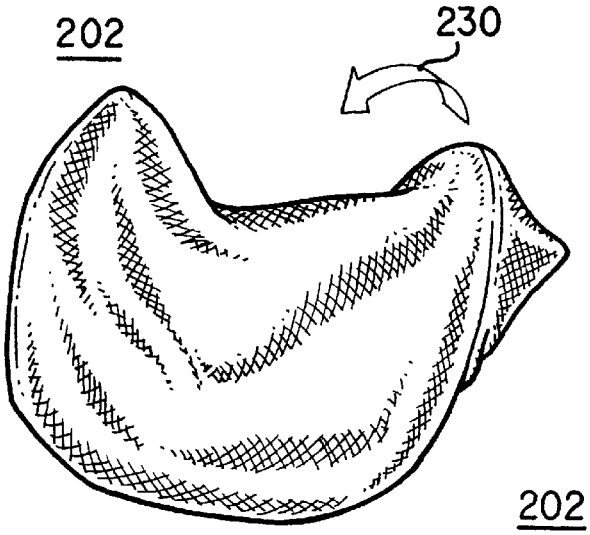
Figure 12C:
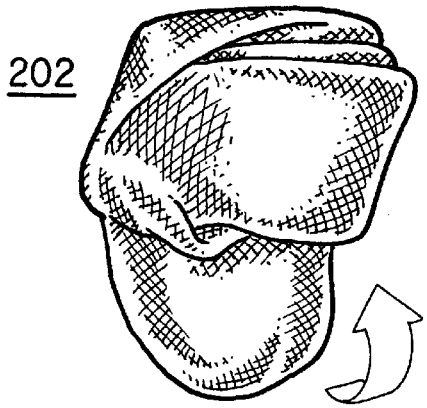
Figure 12D:
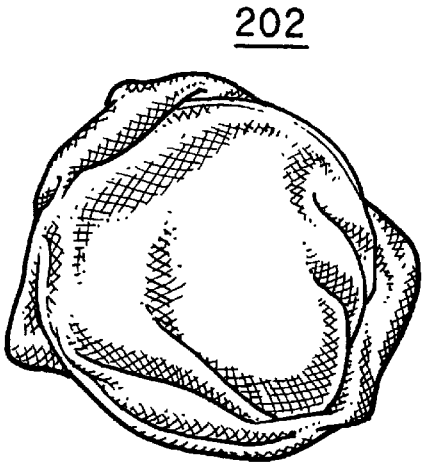
Figure 13:
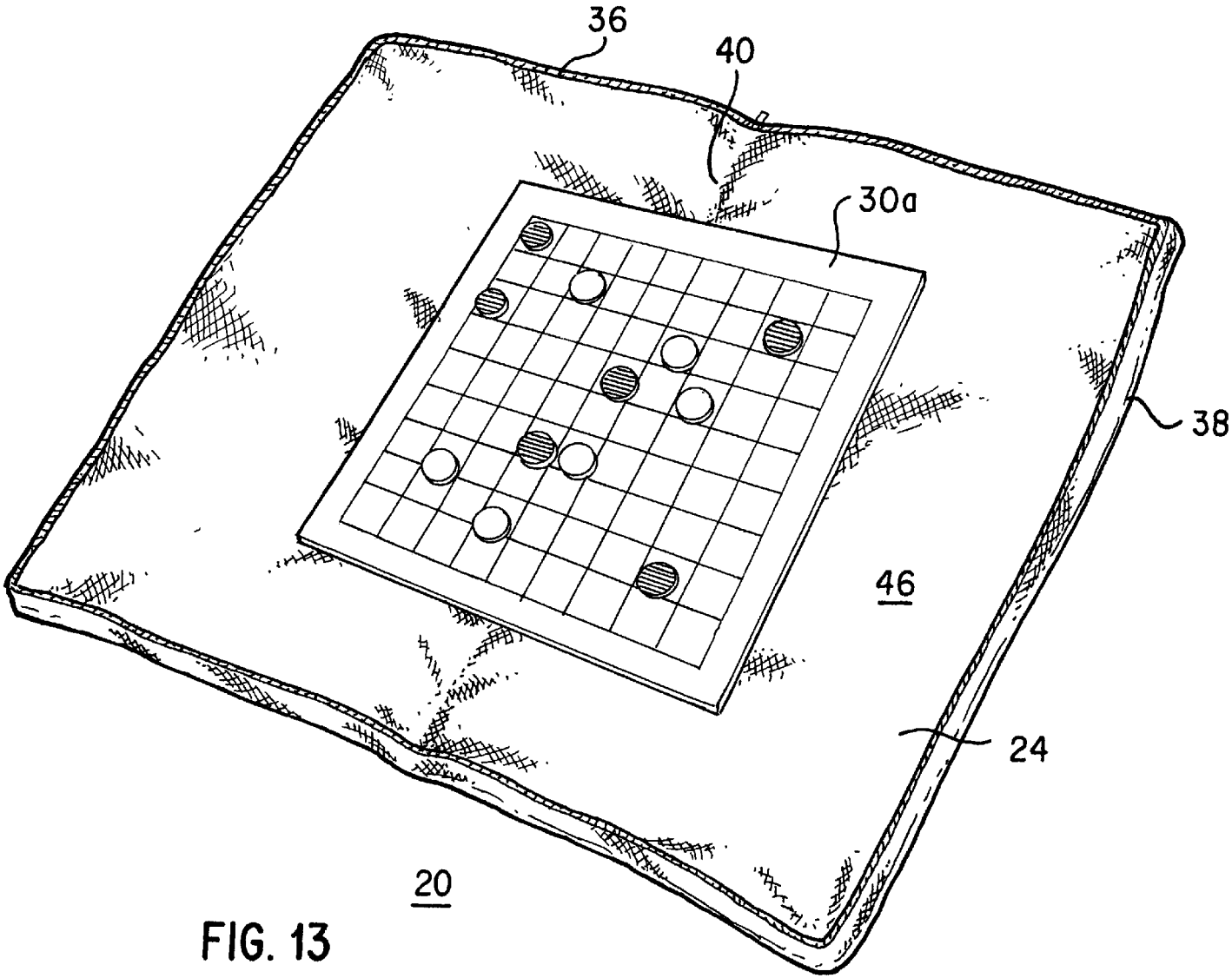
FIG. 13 is a perspective view of the sleeping bag of FIG. 1 illustrating the liner.

FIGS. 12A through 12E describe the various steps for folding and collapsing the panel 202 (and its accompanying blanket portion 204) for storage. In FIG. 12A, the opposite border of the panel 202 is folded in (see arrow 230) to collapse the frame member 224 with the panel 202. As shown in FIG. 12B, the next step is to continue the collapsing so that the initial size of the panel 202 is reduced. FIG. 12C shows the next step with the frame member 224 and panel 202 collapsed on each other to provide for a small essentially compact configuration having a plurality of concentric frame members and layers of the fabric 226 so that the collapsed panel 202 has a size which is a fraction of the size of the initial structure 202, as shown in FIG. 12D.

To re-open the panel 202 to its expanded configuration, the folded panel 202 is unfolded. The memory (i.e., springload) of the frame member 224 will cause the frame member 224 to uncoil on its own and to quickly expand the panel 202 to its expanded configuration shown in FIG. 10.

Any of the features 30 (including electrical components) described above can be provided on either surface 232 or 234 of the blanket portion 204, or on either surface of the fabric 226 of the panel 202. For example, FIG. 10 illustrates a game board 238 provided on the top surface 232 of the blanket portion 204, and another game board 240 provided on the inner surface of the fabric 226. As a result, the panel 202 can be used as the supporting surface for any amusement feature or game board. Alternatively, the blanket portion 204 can include the pad 28 which acts as the supporting surface for any amusement feature or game board.

Figure 15:
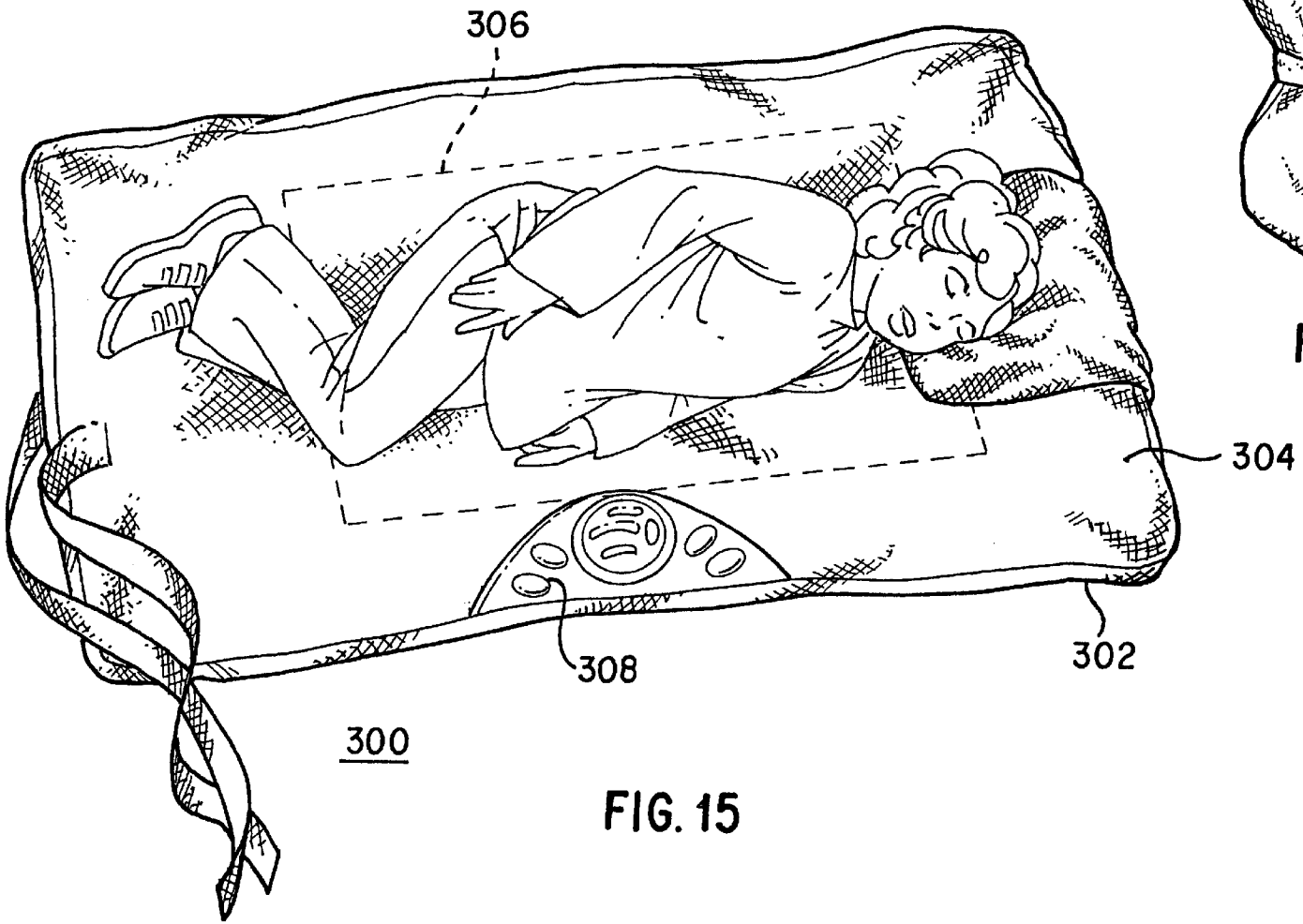
FIG. 15 is a perspective view of a sleeping mat according to yet another embodiment of the present invention.

FIGS. 14 and 15 illustrate other embodiments of the present invention, which exemplify the wide variety of enhancements and features that are provided by the principles of the present invention. For example, FIG. 14 illustrates two sleeping bags 100*a* and 100*b*, each of which can be the same as the sleeping bag 100 in FIG. 7. The difference is that each sleeping bag 100*a* and 100*b* can be coupled to each other via straps 101*a* and 101*b* that are coupled to the electrical circuits in the sleeping bags 100*a* and 100*b*, respectively. Each strap 101*a* and 101*b* can carry a communication port 103*a* and 103*b*, respectively, that can be connected together to link the electrical systems in the two sleeping bags 100*a* and 100*b*. Additional straps (e.g., 105*b*) can be provided for each sleeping bag (e.g., 100*b*) to allow the sleeping bag to be electronically coupled to other sleeping bags.

Figure 16:
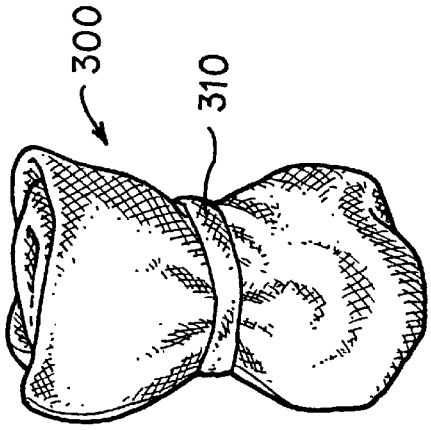
FIG. 16 illustrates the sleeping mat of FIG. 15 in a rolled-up orientation for storage.

Although most of the embodiments of the present invention are illustrated as being in the form of a sleeping bag, the principles of the present invention are equally applicable to sleeping mats. FIG. 15 illustrates a sleeping mat 300 that can be configured in the same manner as the sleeping bag 20, in that it has an outer layer 302 (corresponding to the outer layer 22) and a liner 304 (corresponding to the liner 24) that are connected together to form a two-layer panel. The difference between the mat 300 and the sleeping bag 20 is that the mat 300 is not folded over about a centerline. The mat 300 can also have a pad 306 (which can be the same as pad 28), shown in phantom in FIG. 15) provided between the outer layer 302 and the liner 304. Any of the features described herein (e.g., game boards, electrical elements, touch pads, three-dimensional toys, sports, etc.) can be provided on the surfaces of the outer layer 302 and/or the liner 304 using the principles described hereinabove. For example, a speaker 308 is illustrated as being provided on the liner 304. The mat 300 can be rolled up for storage, as shown in FIG. 16. A strap or band 310 can be used to tie the rolled-up mat 300 during storage. In fact, any of the sleeping bags 20, 50, 70, 80 and 100 can be rolled up in the same manner for storage.

Thus, the embodiments of the present invention increase the applications and use of a conventional sleeping bag to provide the user with an unlimited source and variety of fun and entertainment. The enhancements and features allow numerous functions, operations, and games to be utilized or played in connection with the sleeping bag, and significantly extends the useful applications of the sleeping bag.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A sleeping apparatus, comprising:

a first layer having a peripheral edge and an outer surface;

a second layer having an outer surface, and a peripheral edge that is attached to the peripheral edge of the first layer along the entirety of the peripheral edges so as to define an enclosed space between the first and second layers;

a rigid pad positioned in the enclosed space between the first and second layers in a manner, wherein the pad has at least one pre-formed fold line; and an amusement feature provided on the outer surface of either the first layer or the second layer.

2. The apparatus of claim 1, wherein the amusement feature is a game board.

3. The apparatus of claim 1, wherein the amusement feature is removably attached to the outer surface of either the first layer or the second layer.

4. The apparatus of claim 1, wherein the amusement feature is a three-dimensional toy.

5. The apparatus of claim 1, wherein the amusement feature includes at least one electrical device.

6. The apparatus of claim 5, wherein the amusement feature includes a plurality of electrical devices coupled to each other by electrical coupling.

7. The apparatus of claim 6, wherein the electrical coupling includes conductive path.

8. The apparatus of claim 6, wherein the electrical coupling includes wires.

9. The apparatus of claim 1, wherein the first and second layers are made from a woven material.

10. A sleeping apparatus, comprising:

a first layer having a peripheral edge and an outer surface;

a second layer having an outer surface, and a peripheral edge that is attached to the peripheral edge of the first layer along the entirety of the peripheral edges so as to define an enclosed space between the first and second layers;

an amusement feature provided on the outer surface of either the first layer or the second layer; and a rigid pad coupled to the outer surface that the amusement feature is provided on, the rigid pad providing a support for the amusement feature, wherein the pad has at least one pre-formed fold line.

11. The apparatus of claim 10, wherein the amusement feature is removably attached to the outer surface of either the first layer or the second layer.

12. The apparatus of claim 10, wherein the amusement feature includes at least one electrical device.

13. The apparatus of claim 12, wherein the amusement feature includes a plurality of electrical devices coupled to each other by electrical coupling.

14. The apparatus of claim 13, wherein the electrical coupling includes conductive path.

15. The apparatus of claim 13, wherein the electrical coupling includes wires.

16. The apparatus of claim 10, wherein the first and second layers are made from a woven material.

17. The apparatus of claim 10, wherein the amusement feature is a game board.

18. The apparatus of claim 10, wherein the amusement feature is a three-dimensional toy.

* * * * *